US010087028B2

(12) United States Patent
Röyskö et al.

(10) Patent No.: US 10,087,028 B2
(45) Date of Patent: Oct. 2, 2018

(54) ARRANGEMENT IN A PERFORATED ROLL OF A FIBER WEB MACHINE AND PREFABRICATED SENSOR SHEET FOR A PERFORATED ROLL OF A FIBER WEB MACHINE

(71) Applicants: Kari Röyskö, Pirkkala (FI); Heikki Kettunen, Espoo (FI); Tatu Pitkänen, Nummenkylä (FI)

(72) Inventors: Kari Röyskö, Pirkkala (FI); Heikki Kettunen, Espoo (FI); Tatu Pitkänen, Nummenkylä (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 275 days.

(21) Appl. No.: 15/171,767

(22) Filed: Jun. 2, 2016

(65) Prior Publication Data

US 2016/0355362 A1 Dec. 8, 2016

(30) Foreign Application Priority Data

Jun. 3, 2015 (FI) ..... 20155421

(51) Int. Cl.

| | |
|---|---|
| ***B65H 27/00*** | (2006.01) |
| ***D21F 3/10*** | (2006.01) |
| *D21F 5/04* | (2006.01) |
| *D21F 1/76* | (2006.01) |
| *D21F 1/36* | (2006.01) |

(52) U.S. Cl.

CPC ..... *B65H 27/00* (2013.01); *D21F 3/10* (2013.01); *D21F 3/105* (2013.01); *D21F 1/36* (2013.01); *D21F 1/76* (2013.01); *D21F 5/042* (2013.01)

(58) Field of Classification Search

CPC ..... D21F 1/76; D21F 1/36; D21F 3/10; D21F 3/105; D21F 5/042

USPC ..... 492/9, 10, 11

See application file for complete search history.

(56) References Cited

U.S. PATENT DOCUMENTS

| | | | | |
|---|---|---|---|---|
| 4,051,719 | A * | 10/1977 | Loch | G01N 27/048 73/73 |
| 4,055,077 | A * | 10/1977 | Loch | G01N 27/048 73/73 |
| 6,341,522 | B1 * | 1/2002 | Goss | D21F 7/06 73/159 |
| 2004/0053758 | A1 * | 3/2004 | Gustafson | D21F 3/06 492/10 |
| 2006/0248723 | A1 * | 11/2006 | Gustafson | D21F 3/06 29/895.32 |

FOREIGN PATENT DOCUMENTS

EP 1719836 A1 11/2006

* cited by examiner

*Primary Examiner* — Jason L Vaughan
(74) *Attorney, Agent, or Firm* — Stiennon & Stiennon

(57) ABSTRACT

A perforated roll (10) of a fiber web machine includes a roll shell (19), holes (13) extending through the roll shell, and a sensing system (14) arranged in the roll shell. The sensing system (14) includes at least one pair of leads (16), to which one or more sensors (15) have been connected. At least one pair of leads is composed of flat leads (17.2, 17.2), which are arranged in the roll shell side by side. A prefabricated sensor sheet (26) may be prepared for a perforated roll of a fiber web machine, such that holes may be drilled therethrough to communicate with the roll shell holes (13).

15 Claims, 10 Drawing Sheets

ARRANGEMENT IN A PERFORATED ROLL OF A FIBER WEB MACHINE AND PREFABRICATED SENSOR SHEET FOR A PERFORATED ROLL OF A FIBER WEB MACHINE

CROSS REFERENCES TO RELATED APPLICATIONS

This application claims priority on Finnish app. No. FI 20155421, filed Jun. 3, 2015, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an arrangement in a perforated roll of a fiber web machine, which arrangement includes:

a roll shell, holes adapted through the roll shell, a sensing system arranged in the roll shell, which sensing system includes at least one pair of leads, to which one or more sensors have been connected.

The invention also relates to a prefabricated sensor sheet for a perforated roll of a fiber web machine.

It is known that various nip measurements are performed for example in connection with service shutdowns on fiber web machines. In these, a temporary sensing system arranged because of the measurements is arranged on the surface of a roll, the measurement is performed, and the sensing system is removed. For example the so-called E-nip measurement technology represents prior art. It can be used for measuring the cross-sectional profile of the length of the nip in static conditions, but the measurement does not directly measure the cross-sectional distribution of the nip pressure or the MD distribution of the pressure. Moreover, one known measurement is Valmet Technologies, Inc.'s iRoll portable measurement, which can be used for measuring the cross-sectional profile of the nip pressure/force by means of a sensor installed temporarily on the surface of the roll.

The arrangement of a sensing system for example in the suction roll of a fiber web machine is known from European patent publication 1 719 836 B1. The sensing system includes a pair of leads embedded in the shell of the roll, to which pair of leads one or more sensors have been connected to determine various issues in the roll. The leads of the pair of leads are taken from between through holes arranged in the roll shell to the end of the roll and from there further to a processor. In the processor, the measurement signal established by the sensors and transmitted by the pair of leads is analyzed so as to perform various measurements. The sensors have been arranged around holes, in which case the sensors have an opening for the hole. It is troublesome to take the leads of the pair of leads between the through holes, and this hence raises the manufacturing costs of the roll. Moreover, when the sensor is around the holes, it may get damaged when the through holes are drilled in the roll shell.

Attempts have been made to solve the problem related to the arrangement of the sensing system also for example so that the location of the sensing system is provided with blind drilled holes in terms of the through holes, and the rest of the roll shell is drilled in a manner defined or accepted by the end user of the roll. The angle of pitch of the sensing system with respect to the axis of the roll can be calculated so that the pitch of the drilling patterns of the blind drilled holes is constant, for example 1, 2, 3 . . . drilling patterns per shift in the circumferential direction of the drilling pattern. In this case, the number of shifts of the drill bits from one side of the sensing system to the other is always constant in the drilling stage. In this way, the goal has been to make the drilling work as easy as possible, to avoid errors in the work and to perform the work quickly. There are so many drilling patterns of blind drilled holes on top of each other in the circumferential direction of the roll that the sensing system fits completely inside the drilling patterns of blind drilled holes. FIG. 1 shows an example image of the blind drilled holes at the sensing system location of a suction roll. The rastered areas on the roll shell are blind drilled holes with a pitch of 2, and the unrastered areas are normal through holes. However, the shortcoming of this solution is the uneven perforation of through holes on the roll, because there are no through holes at the sensing system locations. Moreover, here the drilling of the through holes requires specific measures in each drilling sequence, for example in the form of the shifting of the drill bits.

The purpose of the present invention is to accomplish an arrangement in a perforated roll of a fiber web machine, as a result of which it is simpler and quicker to arrange a sensing system in a perforated roll than in prior art solutions. Another purpose of the present invention is to also accomplish a prefabricated sensor sheet for a perforated roll of a fiber web machine, by means of which prefabricated sensor sheet it is simpler and quicker to arrange a sensing system in a perforated roll of a fiber web machine.

SUMMARY OF THE INVENTION

In the present invention, at least one pair of leads included in the sensing system has been adapted to be composed of flat leads, which have been arranged side by side in the roll shell. It is easy to fasten a flat lead to the surface included in the roll shell because of its relatively large bond surface. Another advantage of the flat lead is that it remains fastened more reliably when the roll is coated after the arrangement of the sensing system. Moreover, being a relatively low structure, the flat lead does not disturb the coating of the roll.

In accordance with a more advanced embodiment, the width of the flat leads can be greater than the diameter of the through holes arranged in the roll shell at the location of the flat leads. This dimensioning enables degrees of freedom in the arrangement of the sensing system. In line with this, at least one pair of leads included in the sensing system can travel more freely than in prior art irrespective of the location of the through holes on the roll shell. A flat lead included in a pair of leads can even travel at the location of a through hole without the flat lead breaking, in other words without losing its signal transmission capability. This simplifies the arrangement of the sensing system and also the manufacture of the roll, because the pair of leads no longer essentially restricts the drilling of holes in the roll shell. If a flat lead coincides with a hole to be drilled, a cut is formed in it at the location of the hole in question. However, due to the suitably dimensioned width of the flat lead, the hole does not break the flat lead completely, but it can still transmit a signal forward over its intact portion.

In accordance with one embodiment, the sensor can be adapted between the flat leads. In this case, the sensor can be located for example between holes, in other words on a neck formed on the roll shell between holes. In this way, also the sensor is safe when through holes are drilled in the coating of the roll shell. The other additional advantages to be achieved with the invention are disclosed in the description of the invention.

The invention, which is not restricted to the embodiments presented below, is described in more detail by making reference to the enclosed drawings.

BRIEF DESCRIPTION OF THE DRAWINGS

FIG. 8*c*.1 is a partial view of the region 8*c*.1 indicated in FIG. 8*c*.

FIG. 8*d*.1 is a partial view of the region 8*d*.1 indicated in FIG. 8*d*.

FIG. 8*e*.1 is a partial view of the region 8*e*.1 indicated in FIG. 8*e*.

DESCRIPTION OF THE PREFERRED EMBODIMENTS

Figure 1:
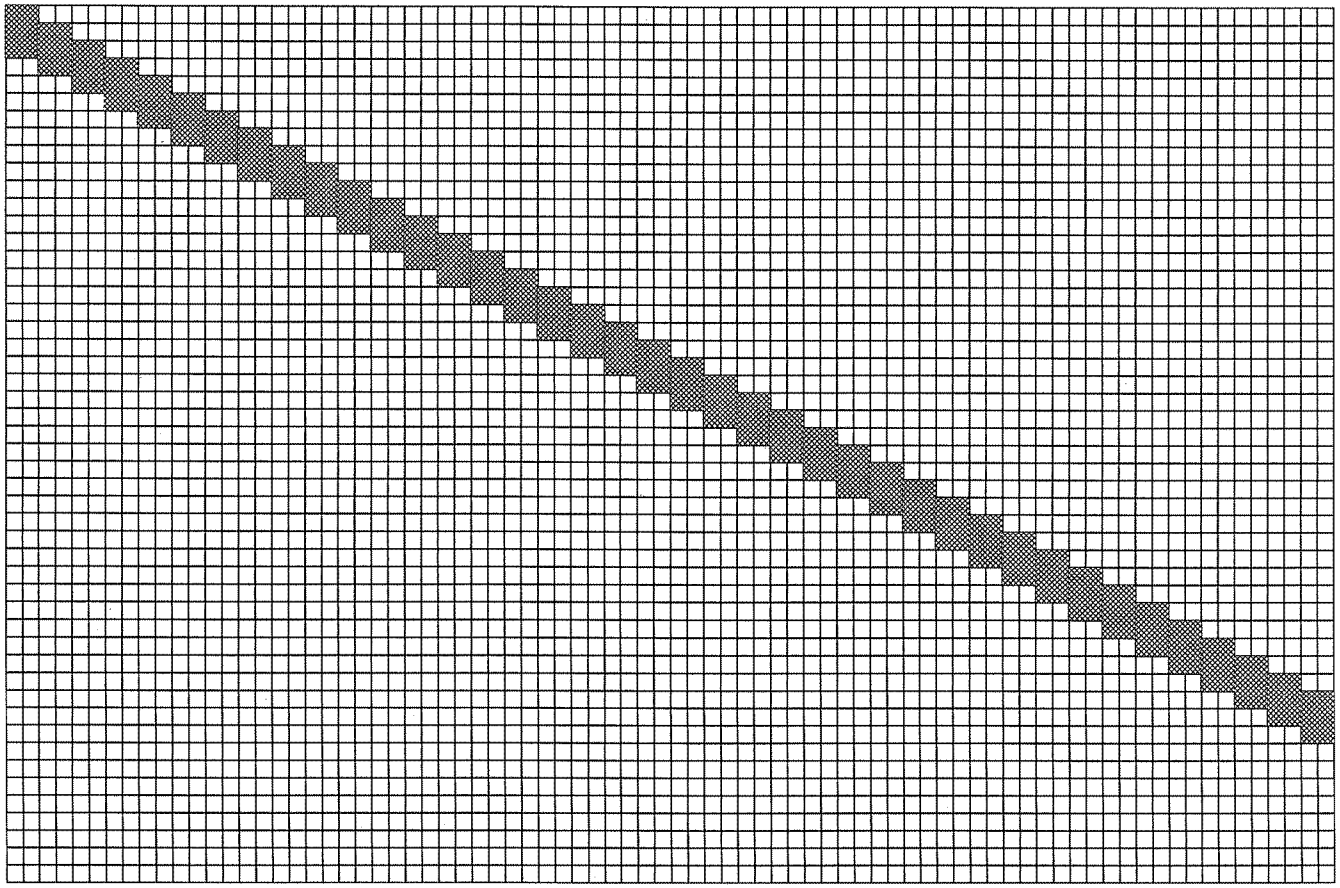
Prior Art Fig. 1
FIG. 1 is a graph showing the placing of blind holes in an array of holes in a prior art arrangement of a sensing system in a perforated roll.
Figure 2:
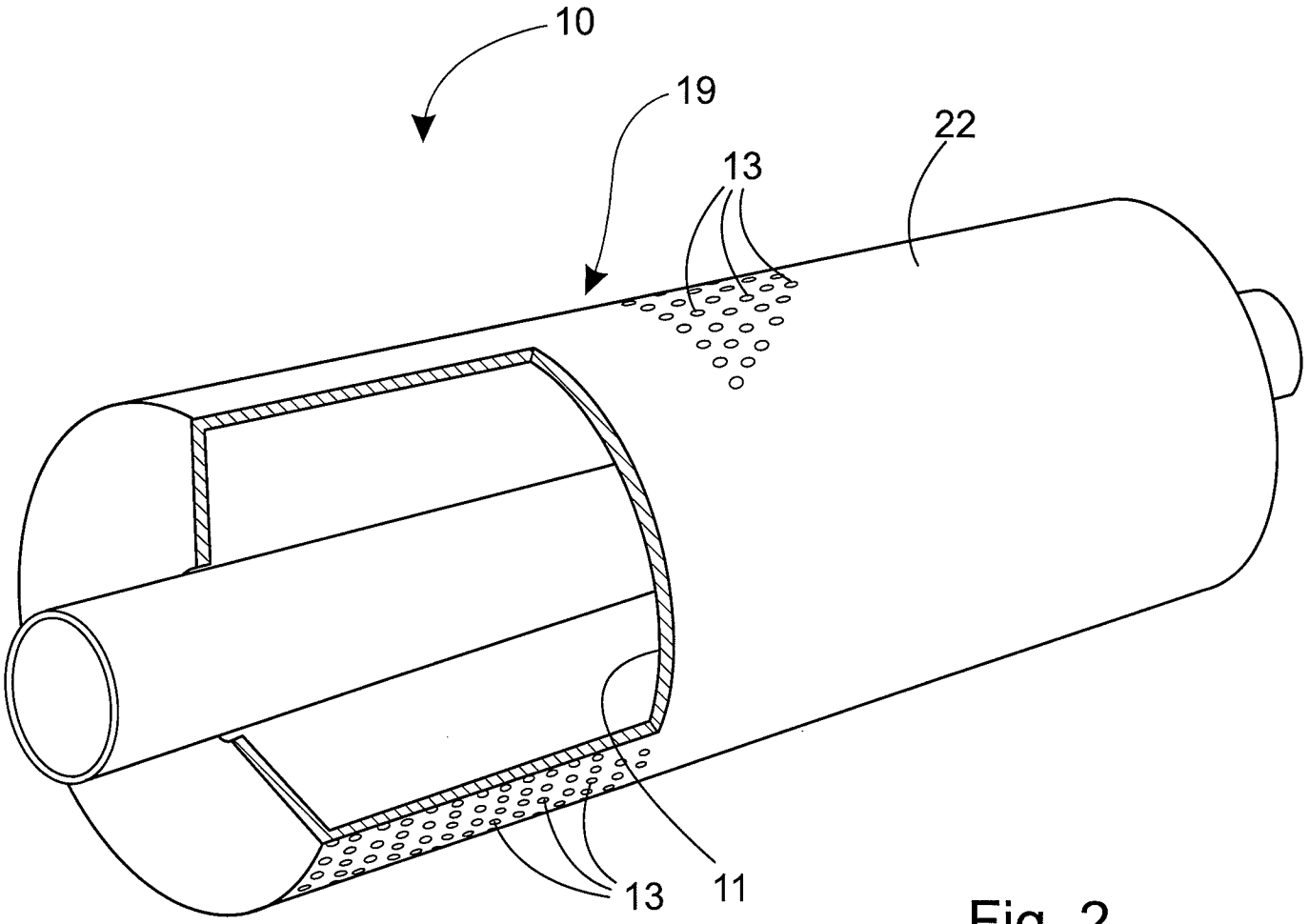
FIG. 2 is a perspective view, partially cut away in section of an example in principle of a perforated roll of a fiber web machine, shown diagonally from an end.

FIG. 2 shows an example in principle of a perforated roll 10 of a fiber web machine, examined diagonally from an end and partially cut open. The perforated roll 10 can be for example a suction roll, which is used for example in the forming and press sections of a fiber web machine. The perforated roll 10 comprises a perforated roll shell 19, a flanged shaft with bearings, and a suction box (not presented) placed inside the roll shell 19. Flanged shafts have been fastened to the ends of the roll shell 19, and the perforated roll 10 has been mounted on the flanged shafts by means of bearings. On the other hand, the perforated roll shell 19 of the perforated roll 10 rotates or is rotatable on bearings supported by the flanged shaft.

The perforated roll 10 is hollow on the inside. In the case of a suction roll, a negative pressure is formed inside the perforated roll 10. Inside the roll shell 19, there can be a suction box with one or more chambers, and the suction openings of the suction box open to the inner surface of the roll shell 19 restricted by seal strips. The roll shell 19 has a perforation of through holes 13, through which the negative pressure formed inside the perforated roll 10 can influence to the outside of the roll. By means of the negative pressure prevailing in the chamber of the suction box, a vacuum is created under the paper web through a wire of fabric. Through the perforation of through holes, the pressure difference created removes water from the web and/or fabric to the holes 13 of the roll shell 19 and/or holds the web during a transfer. In addition to the press section, the perforated roll 10 can be used for example for the transfer of the web onto a roll or between different structural groups.

Figure 3:
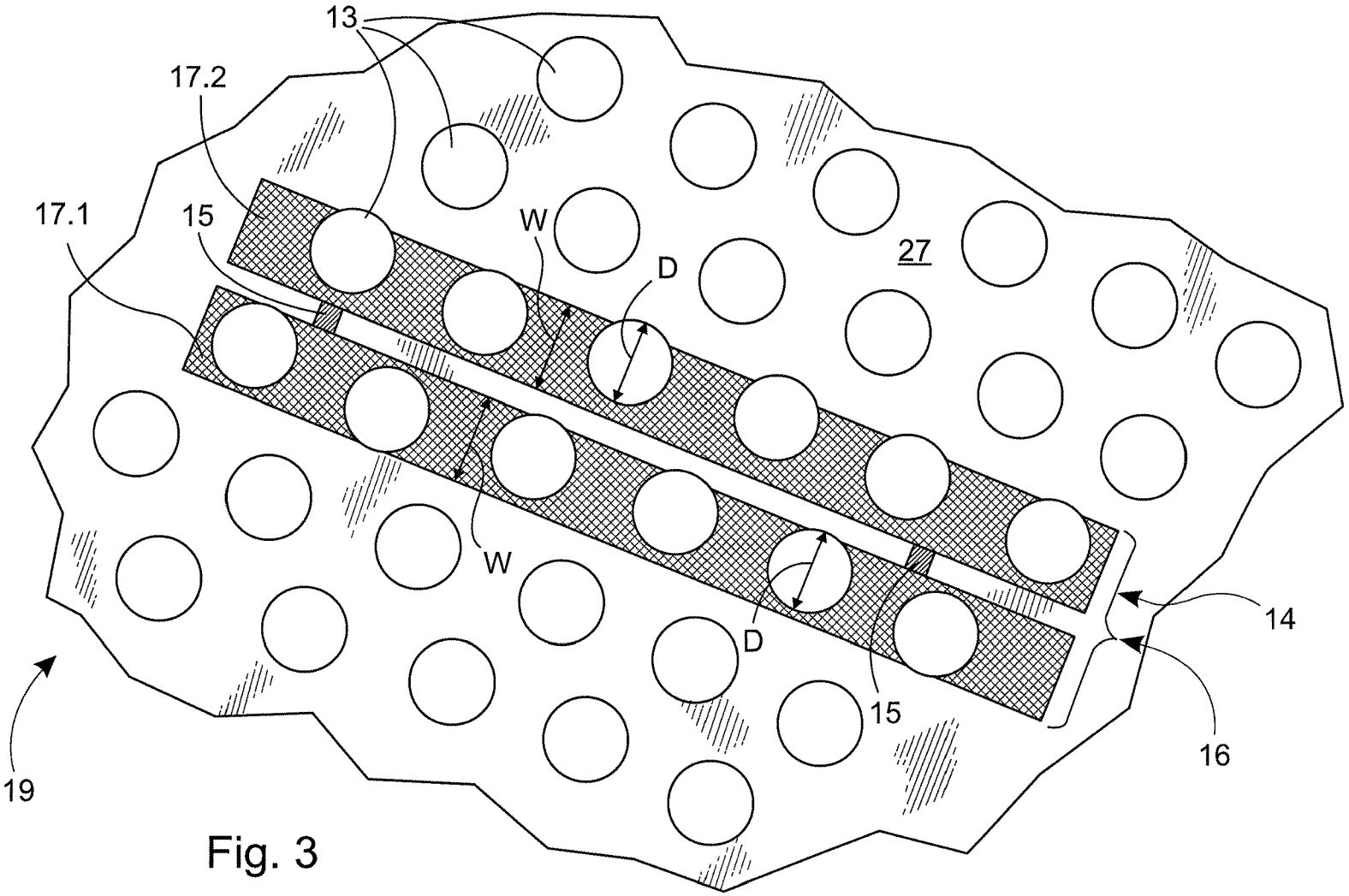
FIG. 3 is a fragmentary surface view of a first embodiment of a sensing system of a perforated roll.
Figure 4:
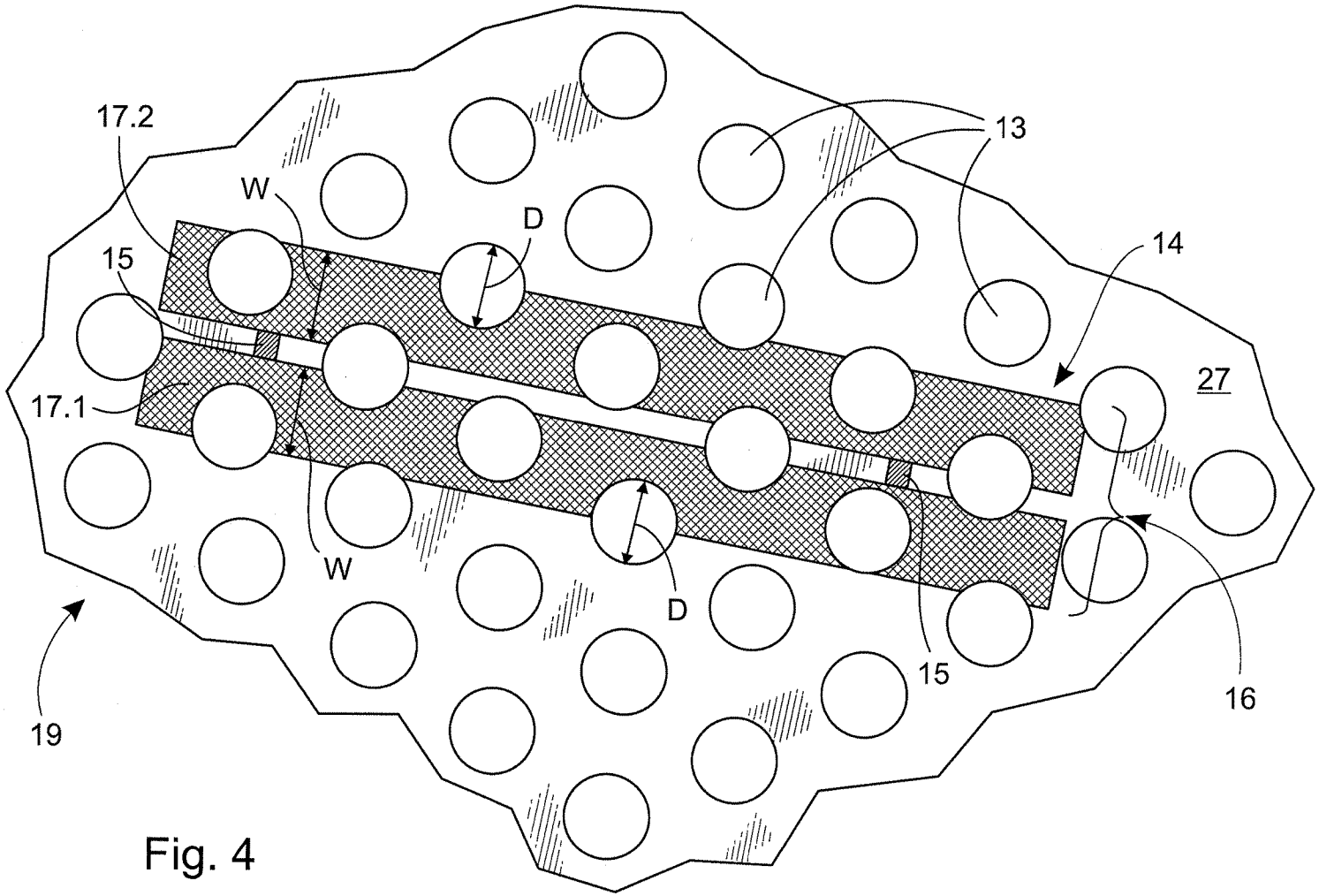
FIG. 4 is a fragmentary surface view of a second embodiment of a sensing system of a perforated roll.
Figure 5:
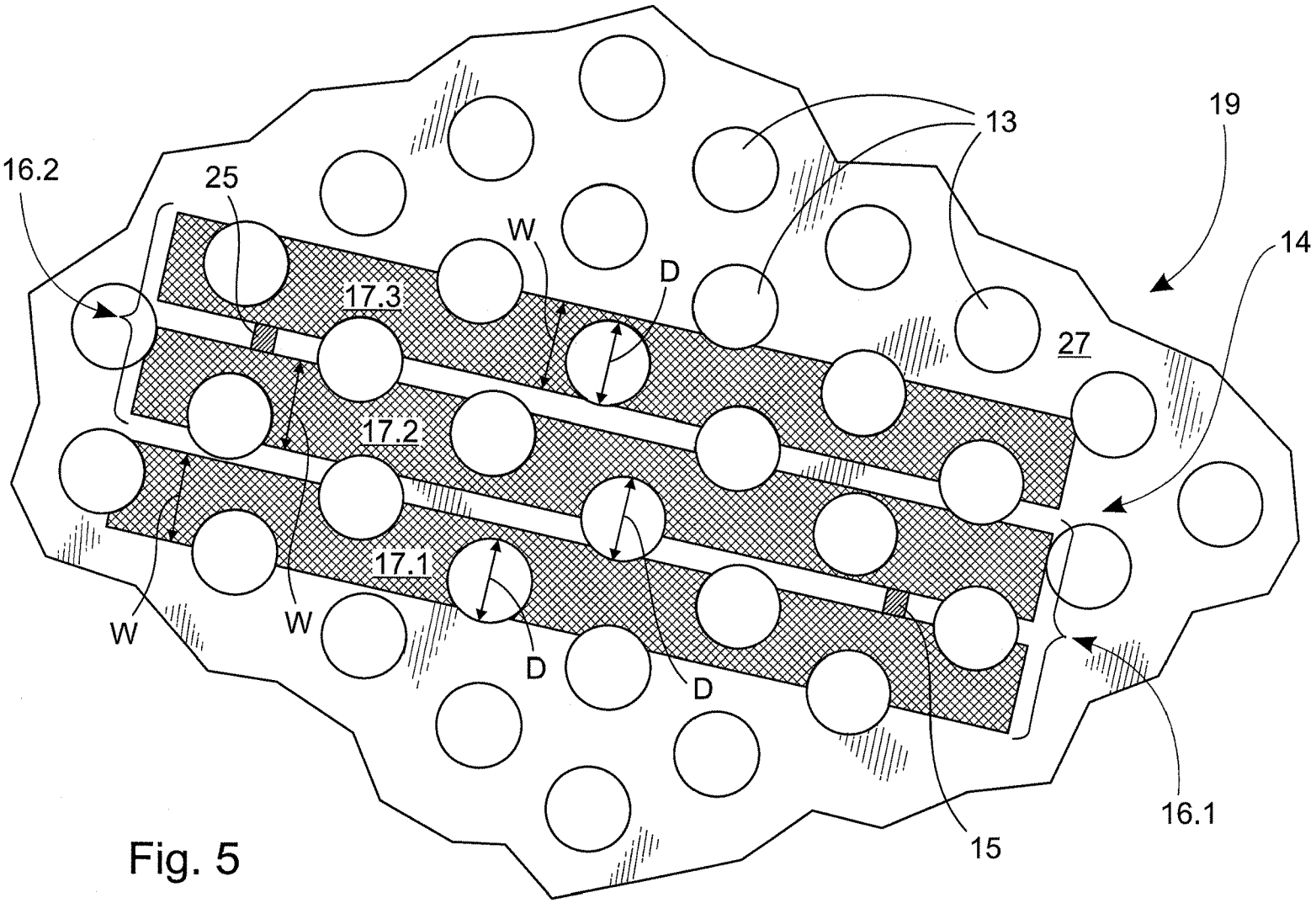
FIG. 5 is a fragmentary surface view of a third embodiment of a sensing system of a perforated roll.

FIGS. 3-5 show some embodiments of the arrangement of a sensing system 14 in the perforated roll 10. FIG. 3 shows the first embodiment of the sensing system 14 of the perforated roll 10 when examining the perforation of the roll from above without a coating that can be arranged over the sensing system 14. In general, the arrangement in the perforated roll 10 of a fiber web machine includes a roll shell 19, holes 13 adapted through the roll shell 19 and a sensing system 14 arranged in the roll shell 19. The sensing system 14 includes at least one pair of leads 16, to which one or more sensors 15 have been connected.

The sensors 15 are used for establishing a measurement signal, which is transmitted to a measurement arrangement (not presented) by means of a pair of leads 16. The measurement arrangement can be for example a known prior art arrangement or one that is only being developed. The measurement arrangement can include at least one processor unit adapted to analyze the measurement signal established to the processor by means of the pair of leads 16.

At least one pair of leads 16 adapted in the roll shell 19 has been adapted to be composed of flat leads 17.1, 17.2. The flat leads 17.1, 17.2 can be strip-like elongated leads, the width W of which is greater than their thickness. One example of the width W of the flat leads 17.1, 17.2 is 4-30 mm and more specifically 6-20 mm. The thickness of the flat leads 17.1, 17.2 can be for example in the micrometer range. The material of the flat leads 17.1, 17.2 can be some electrically conductive material such as copper. It is easy to fasten the flat leads 17.1, 17.2 to an installation surface 27 included in the roll shell 19. Moreover, they provide reliable fastening, which does not disturb the arrangement of a coating 12 potentially included in the roll shell 19 over the sensing system 14, as indicated in FIGS. 8*b*-8*e*.

The width W of the flat leads 17.1, 17.2 that transmit the measurement signal established by the sensors 15 has been adapted to be greater than the diameter D of the holes 13 adapted in the roll shell 19 (at the location of the sensing system 14). In other words, due to the suitable dimensioning of the flat leads 17.1, 17.2, the lead structures become so wide that a hole 13 can be drilled through them without causing the breaking of the flat leads 17.1, 17.2. In this way, a hole 13 can be in the middle of the flat lead 17.1, 17.2 or at the edge of the flat lead 17.1, 17.2. If a hole 13 is in the middle of the flat lead 17.1, 17.2, the edges of the flat lead 17.1, 17.2 remain intact and hence transmit the signal. If a hole 13 is at an edge of the flat lead 17.1, 17.2, one edge of the flat lead 17.1, 17.2 continues to transmit the signal. Especially with a suitable angle of pitch, a hole 13 is only partially at the location of the flat lead 17.1, 17.2. This enables more degrees of freedom for the arrangement of both the sensing system 14 and the perforation in the roll shell 19.

Figure 6:
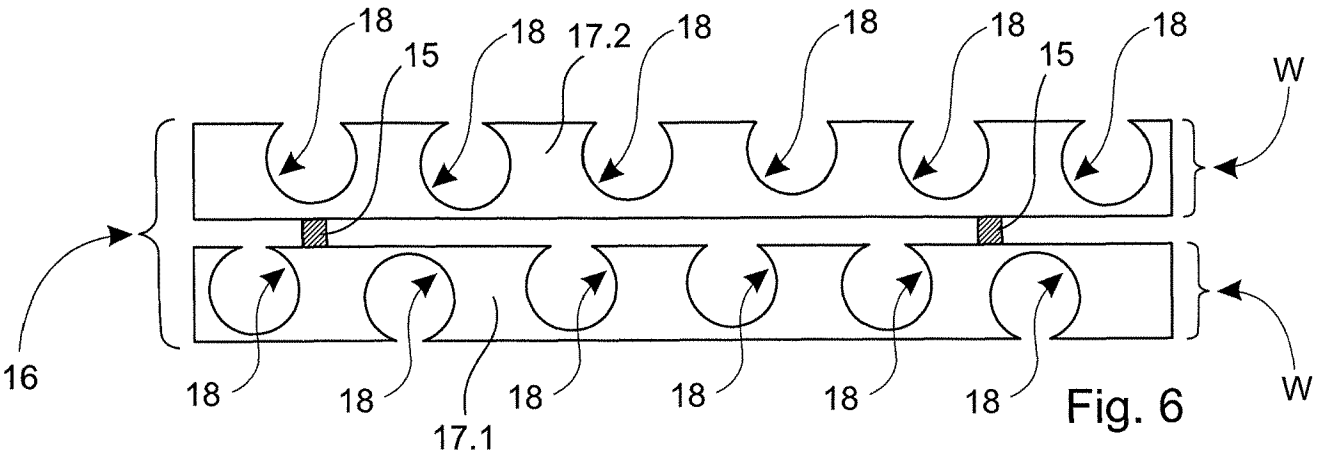
FIG. 6 is a plan view of the sensing system of the arrangement of FIG. 3 separate from the roll.

FIG. 3 shows an embodiment, where the sensing system 14 is spiral and follows the primary angle of pitch of the drilling pattern of the holes 13. It is typically favorable for example for pressure profile measurements. In accordance with the embodiment, at least one flat lead 17.1, 17.2 has cuts 18, and in this case both flat leads 17.1, 17.2 have cuts 18 (FIG. 6) at the location of the holes 13. In other words, the drilling has been adapted to cut the flat lead 17.1, 17.2. The cuts 18 can be seen well in FIG. 6, which shows the sensing system 14 presented in FIG. 3 separate from the perforated roll 10. In this way, in FIGS. 3-5 the cuts correspond in principle to the shape of the holes 13. Since the sensing system 14 can be arranged, due to the flat leads 17.1, 17.2, freely on the roll shell 19 without the hole pattern/angle of pitch restricting or determining the shape of the spiral, the invention also enables a sensing system 14, which runs less than one revolution around the perforated roll 10. This is often advantageous, because in this way only one location of the sensing system 14 at a time coincides with the nip area.

The sensor 15 can be for example of some pressure sensitive and/or temperature sensitive material, depending on the object of measurement. The sensor 15 can be for example EMFi electric, PVDF electric, piezoelectric, capacitive, resistive, inductive, eddy current or other corresponding sensor. The sensor 15 connected to the pair of leads 16 for example by soldering can be adapted between the flat leads 17.1, 17.2. In this case, the planar flat leads 17.1, 17.2 of the pair of leads 16 are located slightly apart from each other in parallel side by side. In this way, the flat leads 17.1, 17.2 are in the thickness direction of the roll shell 19 primarily at the same depth next to each other. When the sensing system 14 is connected to the edges 29 of the flat leads 17.1, 17.2 (FIG. 7*a*), the sensing system 14 constitutes a low, in other words a flat structure. Moreover, the sensor 15 located between the pair of leads 16 ensures that the flat leads 17.1, 17.2 are fastened to the installation surface continuously also at the location of the sensor element.

Furthermore, the sensor 15 can be adapted between holes 13. In this case, the sensor 15 is apart from the holes 13, in which case its risk of damaging for example during the drilling of the holes 13 is non-existent. The size of the sensors 15 can be selected so that they fit completely on a neck of the roll shell 19 between holes 13. On the other hand, if the sensor 15 is larger than a hole 13, the drilling of a hole 13 at the location of the sensor 15 can also be omitted.

FIG. 4 shows the second embodiment of the sensing system 14 of the perforated roll 10 when examining the perforation of the perforated roll 10. Here, the sensing system 14 does not follow the angle of pitch of the drilling pattern. In this case, the location of the sensors 15 can be adapted to coincide between holes 13. Again, at least one flat lead 17.1, 17.2 has cuts 18, and in this case both flat leads 17.1, 17.2 have cuts 18 (FIG. 6) at the location of the holes 13.

FIG. 5 shows the third embodiment of the sensing system 14 of the perforated roll 10 when examining the perforation of the perforated roll 10. In the embodiments of FIGS. 3 and 4, there was only one measurement channel. In the embodiment of FIG. 5, there are two measurement channels in one sensor structure. In this case, the sensing system 14 includes three flat leads 17.1-17.3, which have now been adapted to form two pairs of leads 16.1, 16.2. At least two sensors 15, 25 have been connected to at least one flat lead 17.2 of the flat leads 17.1-17.3. In this case, the sensors 15, 25 are on the opposite side of the flat lead 17.2.

Figure 7A:
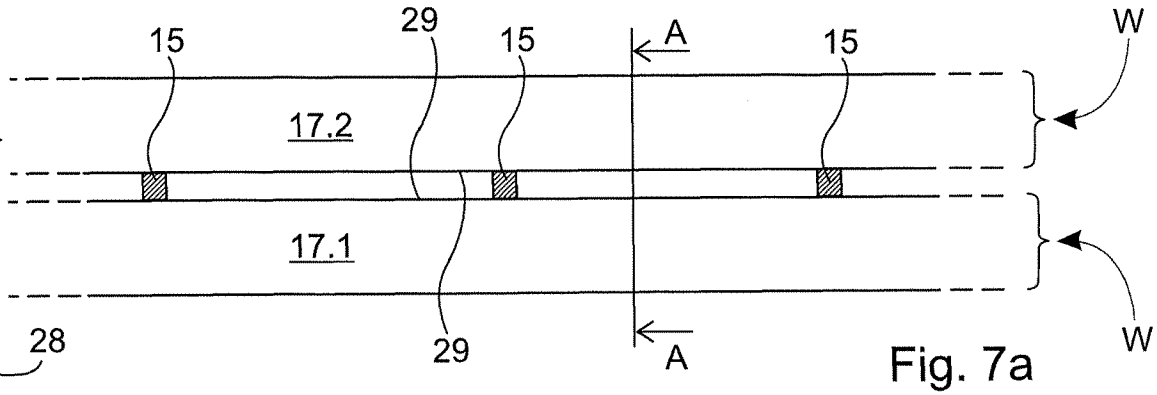
FIG. 7*a* is a fragmentary plan view of a prefabricated sensor sheet for a perforated roll of a fiber web machine.
Figure 7B:
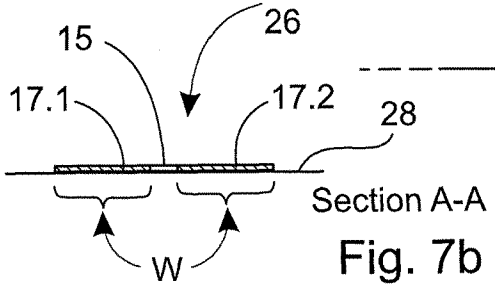
FIG. 7*b* is a cross-sectional view of the prefabricated sensor sheet of FIG. 7*a* taken along section line A-A.

FIG. 7*a* shows an example of a prefabricated sensor sheet 26 for a perforated roll 10 of a fiber web machine viewed from above, and FIG. 7*b* shows the same in cross section. In FIGS. 7*a* and 7*b*, the prefabricated sensor sheet 26 has been presented before the arrangement of the sensing system 14 in the perforated roll 10. The prefabricated sensor sheet 26 includes a background 28, at least one pair of leads 16 and at least one sensor 15. The background 28 can be for example a film-like elongated strip equipped with an adhesive surface on one side, which strip has been adapted to support the sensing system 14 for its installation to an installation surface 27 adapted in the perforated roll 10. On the opposite side of the background 28 with respect to the adhesive surface, there can be at least two parallel flat leads 17.1, 17.2 side by side arranged on the background 28 at a distance from each other, adapted to form at least one pair of leads 16 for the sensing system 14. At least one sensor 15 has been connected to the pair of leads 16.

A sensing system 14 of a specific dimension has been adapted to be cut from the prefabricated sensor sheet 26, which sensing system 14 can be fastened to the installation surface 27 formed on the roll shell 19 of the perforated roll 10. Especially in a sensing system application with a pitch, the flat leads 17.1, 17.2 that constitute the pair of leads 16 together with the sensors 15 connected to them can already be fastened in advance to the background 28, which can be easily glued to the installation surface 27 formed on the roll shell 19 of the perforated roll 10. On the opposite side of the prefabricated sensor sheet 26 with respect to the background 28, there can be a protective film over the flat leads 17.1, 17.2 (not presented). This also holds the sensing system 14 compactly together for example during its installation.

As a result of the prefabricated sensor sheet 26, the sensing system 14 can be made primarily surface installable. In this case, for example the inner cylindrical part 11 of the perforated roll 10 does not need to be machined for example for the sensing system 14 for example for the formation of blind drilled holes.

Figure 8A:
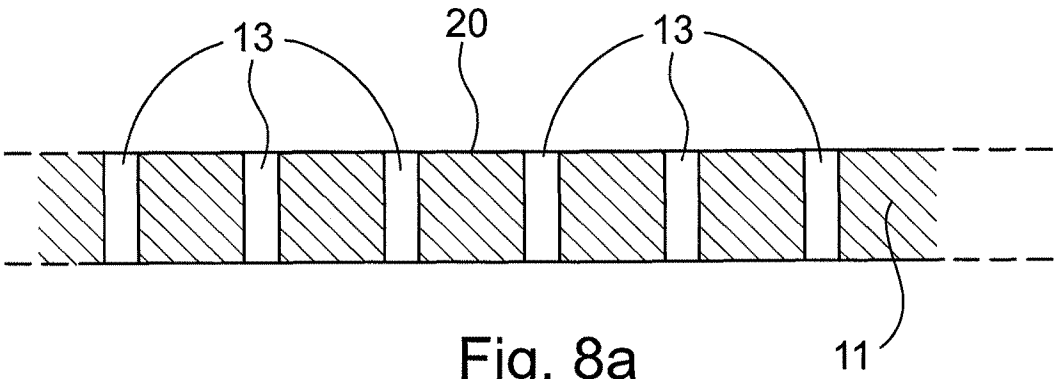
FIG. 8*a* is a fragmentary cross-sectional view of a perforated roll.

FIGS. 8*a*-8*e* show in stages one way of arranging the sensing system 14 in the perforated roll 10, with the roll shell 19 in section. FIG. 8*a* shows the initial situation. In it, the inner, for example metallic, cylindrical part 11 belonging to the roll shell 19 has been equipped with through holes 13, which have been arranged in it by drilling.

Figure 8B:
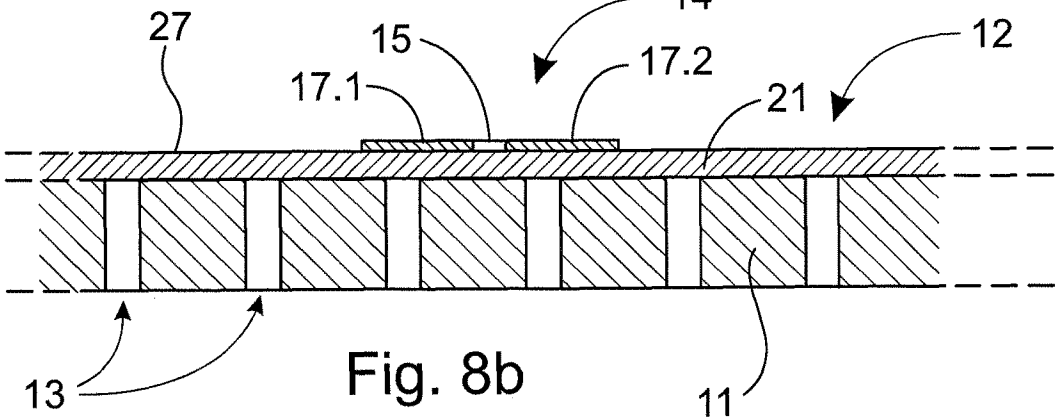
FIG. 8*b* a fragmentary cross-sectional view of the perforated roll of FIG. 8*a*, with a coating applied and a sensing system disposed thereon.

In FIG. 8*b*, a pre-coating layer 21 belonging to the coating 12 has been arranged on the outer surface 20 of the inner cylindrical part 11. The outer surface of the pre-coating layer 21 now forms an installation surface 27 for the sensing system 14. In FIG. 8*b*, the sensing system 14 has been fastened to this installation surface 27. In the presented section, both flat leads 17.1, 17.2 of the sensing system 14 coincide at the location of the holes 13.

Figure 8C:
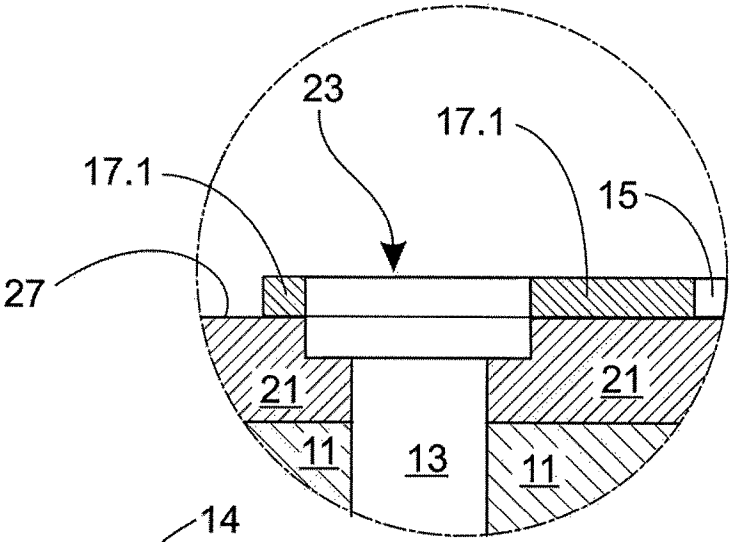
FIG. 8*c* is a fragmentary cross-sectional view of the sensing system on the perforated roll of FIG. 8*b* with blind holes formed in the leads and portions of the coating.
Figure 8C:
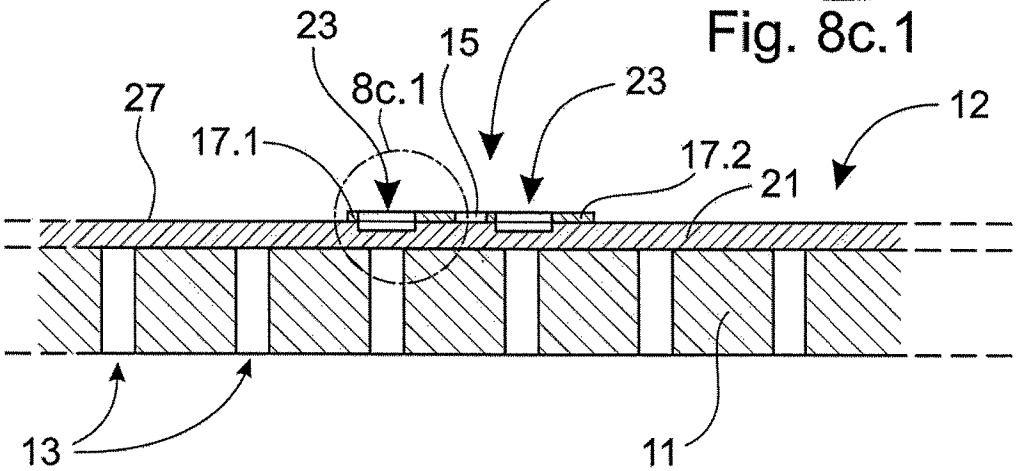

In FIG. 8*c*, recesses 23 have been adapted in the pre-coating layer 21 at the location of the holes 13 in order to arrange an insulation 24 between the flat leads 17.1, 17.2 and a hole 13 (in the radial direction). In other words, the recesses 23 are blind drilled holes, which can be accomplished by means of a drill bit that is oversized with respect to the diameter D of the hole 13. If the diameter D of the hole 13 is for example 4 mm, the recess 23 can be drilled in the flat lead 17.1, 17.2 and in the subsequent pre-coating layer 21 by using a drill bit which has a size of for example 5 mm. In other words, the recess 23 is formed at the location of a hole 13 arranged in the cylindrical part 11, cutting the flat lead 17.1, 17.2 at that location and extending over a distance also to the pre-coating layer 21. On the other hand, the flat leads 17.1, 17.2 can of course also be perforated in advance for example in accordance with the drilling pattern, especially if the sensing system 14 is installed completely in accordance with the pitch of the drilling pattern. The arrangement of the recess 23 presented in the embodiment and the arrangement of the insulation 24 to be formed in it can also be taken into account in this perforation at the same time.

Figure 8D:
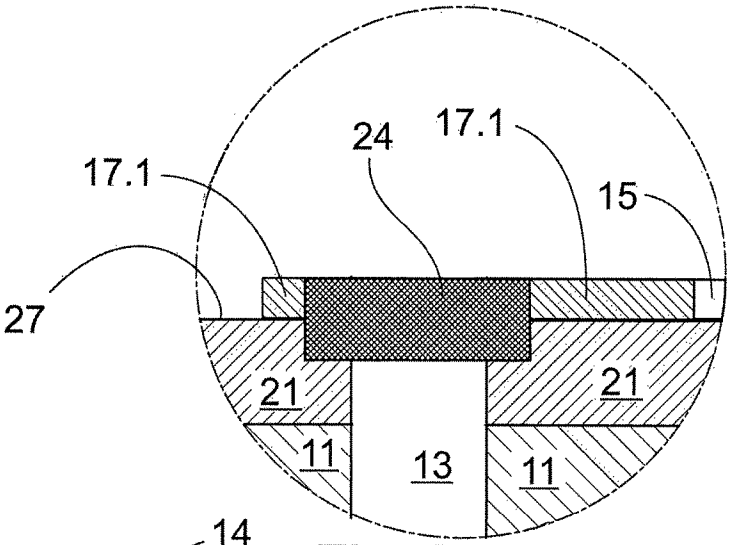
FIG. 8*d* is a fragmentary cross-sectional view of the arrangement of FIG. 8*c* with an insulator disposed within the formed blind holes.
Figure 8D:
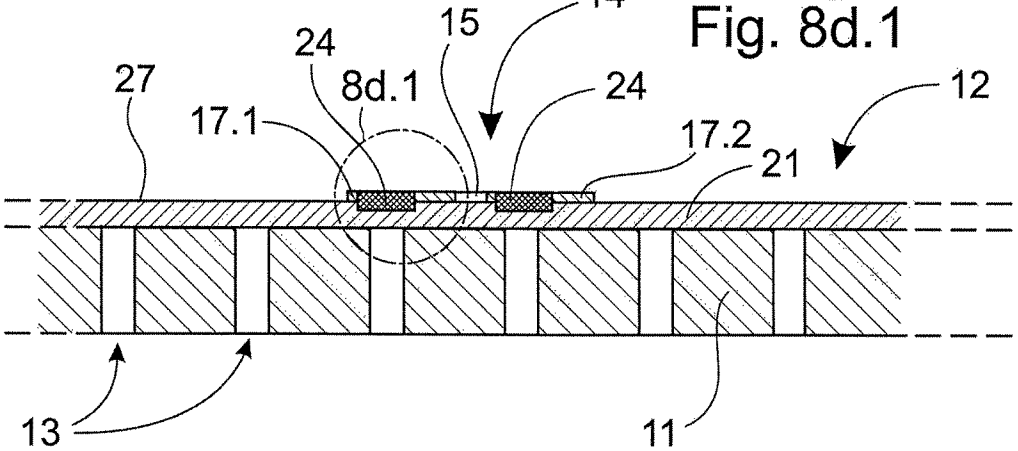

FIG. 8*d* shows a situation, where the recesses 23 have been filled with insulation 24. The insulation 24 can be for example epoxy.

Figure 8E:
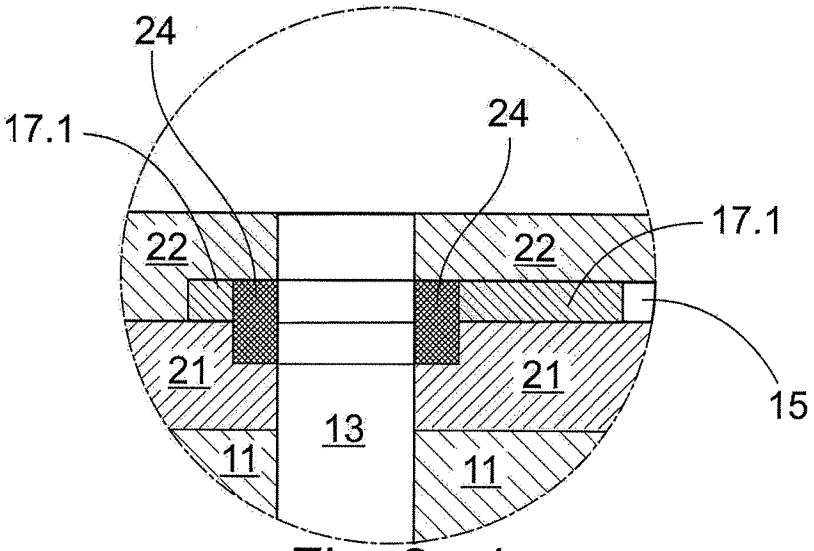
FIG. 8*e* is a fragmentary cross-sectional view of the arrangement of FIG. 8*c* with holes formed through the insulators.
Figure 8E:
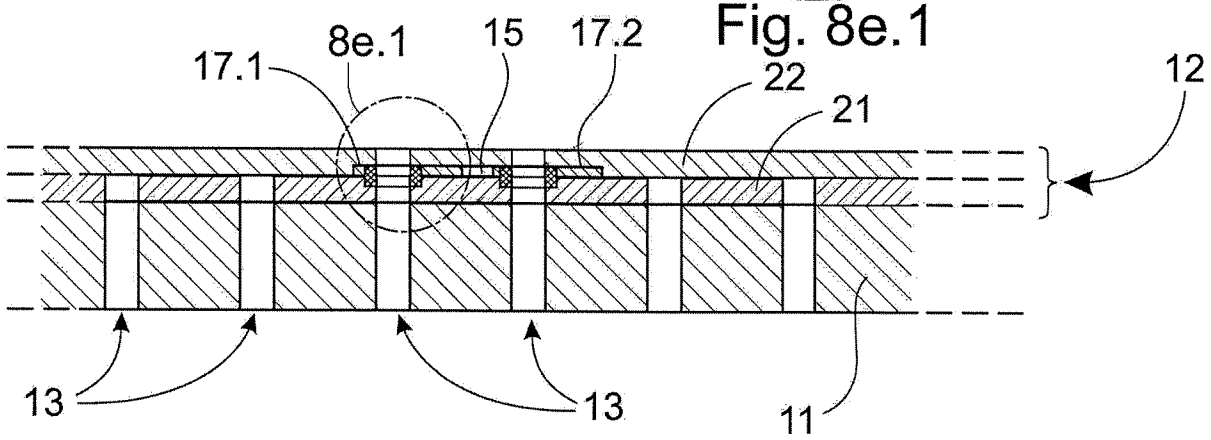

FIG. 8*e* shows a situation, where there is a finished roll shell 19. In it, an outer coating layer 22 has first been adapted over the pre-coating layer 21 and the sensing system 14. The outer coating layer 22 can form the final outer surface of the perforated roll 10, which surface is in contact with the web or fabric. An optional pre-coating layer 21 and outer coating layer 22 together form a coating 12, which has been arranged over the inner hollow cylindrical part 11 belonging to the roll shell 19. The layers 21, 22 of the coating 12 can be for example of some polymeric material, such as for example rubber or polyurethane. The sensing system 14 has been adapted in connection with the coating 12. Most specifically, the sensing system 14 can be adapted, in accordance with the presented embodiment, between the pre-coating layer 21 and outer coating layer 22. On the other hand, the sensing system 14 can also be between the metallic cylindrical part 11 and the coating layer 12.

After the arrangement of the outer coating layer 22, the holes 13 are drilled open at the corresponding locations as the holes 13 arranged in the cylindrical part 11 through the insulation 24 arranged in conjunction with the outer coating layer 22 and the flat leads 17.1, 17.2 of the sensing system 14, using a drill bit of the corresponding size as the diameter D of the holes 13 arranged in the cylindrical part 11. Since the recess 23 presented in FIG. 8*c* and consequently also the insulation 24 arranged in it, presented in FIG. 8*d*, were larger than the diameter D of a through hole 13, some insulation 24 remains in the cut 18 of the flat leads 17.1, 17.2 adapted at the location of a hole 13, between the flat lead 17.1, 17.2 and a through hole 13. In this way, some epoxy remains as insulation in the recess 23 drilled in the flat leads 17.1, 17.2 after the drilling of a final through hole 13 (for example, with a 4 mm hole 13, an area of epoxy approx. 0.5 mm thick remains in the recess 23). The insulation 24 is used for preventing the short circuiting of the flat leads 17.1, 17.2 of the sensing system 14, when the perforated roll 10 is used in wet conditions.

The diameter D of the holes 13 arranged in the roll shell 19 of the perforated roll 10 can be for example 3-6 mm, most specifically for example 4-5 mm. The distance of the holes 13 from each other can be for example 5-10 mm. The distance of the flat leads 17.1, 17.2 belonging to the pair of leads 16 from each other can be for example greater than 1 mm. Correspondingly, the size of the sensor 15 can be for example 1*1 mm.

Above, the invention has been explained with reference to a suction roll. Equally well, the perforated roll 10 can also be a blowing roll or a passive roll (for example on the reel). The arrangement can be arranged in the perforated roll 10 for example in connection with its manufacture, but equally well it can also be made as a retrofit, for example in connection with the recoating of the perforated roll 10. In the context of the invention, the fiber web machine refers to a paper, board and tissue machine and pulp drying machine.

It is to be understood that the above description and the related figures are only intended to illustrate the present invention. The invention is hence not only restricted to the above-presented embodiments or the embodiments defined in the claims, but several different variations and adaptations of the invention will also be obvious to a professional in the field, which variations and adaptations are possible within the inventive idea defined by the enclosed claims.

We claim:

1. An arrangement in a perforated roll of a fiber web machine, the arrangement comprising:
- a roll shell;
- a plurality of first holes extending through the roll shell;
- a sensing system arranged in the roll shell, which sensing system includes at least one pair of leads, to which one or more sensors are connected, wherein the at least one pair of leads comprise a pair of elongated flat leads which have been arranged on the roll shell side by side, each flat lead has a width extending along the surface of the roll shell which is greater than its thickness extending radially outward from the roll shell; and
- wherein the first holes have a first diameter, and wherein the width of each of the flat leads is greater than the first diameter of the first holes.

2. The arrangement of claim 1, wherein at least one of the flat leads has cuts at the location of the first holes.

3. The arrangement of claim 1 wherein the sensor extends between the flat leads.

4. The arrangement of claim 1 wherein the sensor extends between holes.

5. The arrangement of claim 1 wherein the sensing system includes three flat leads which form two pairs of leads, and wherein at least two sensors are connected to at least one flat lead of the flat leads, which sensors are on the opposite side of the flat lead.

6. The arrangement of claim 1 wherein a cut at the location of a first hole includes an insulation between the flat lead and the first hole.

7. The arrangement of claim 1 wherein the roll shell further comprises:
- an inner hollow cylindrical part;
- a coating; and
  - a sensing system arranged over the coating and positioned in connection with the coating.

8. The arrangement of claim 1 wherein the roll shell further comprises an inner cylindrical part with an outer surface, and further comprising:
- a pre-coating layer arranged on the surface of the inner cylindrical part; and
  - an outer coating layer extending over the pre-coating layer, and wherein the sensing system is between the pre-coating layer and the outer coating layer.

9. The arrangement of claim 8, wherein the pre-coating includes a recess at the location of a hole for the arrangement of an insulation between the flat lead and a hole.

10. A prefabricated sensor sheet for mounting to a perforated roll of a fiber web machine, wherein the perforated roll has a roll shell and a plurality of first holes of a first diameter extending through the roll shell, the prefabricated sensor sheet comprising:
- an elongated strip equipped with an adhesive surface on one side for engagement with the perforated roll;
- at least two parallel flat leads on a surface of the elongated strip opposite the adhesive surface, the leads having a thickness extending away from the surface and a width on the surface and forming at least one pair of leads;

at least one sensor connected to the pair of leads and supported on the surface of the elongated strip opposite the adhesive surface; and wherein the width of each of the flat leads is greater than the first diameter of the first holes.

11. The perforated sensor sheet of claim 10 wherein the at least one sensor is selected from the group consisting of an EMFi electric sensor, a PVDF electric sensor, a piezoelectric sensor, a capacitive sensor, a resistive sensor, an inductive sensor, and an eddy current sensor.

12. The perforated sensor sheet of claim 10 wherein the at least one sensor has a thickness substantially the thickness of the at least two flat leads.

13. A perforated roll for a fiber web machine, comprising:

a cylindrical roll shell having an outer surface, wherein portions of the roll shell define a plurality of first holes of a first diameter which extend through the outer surface and the roll shell;

a first flat lead having a first width extending along the outer surface of the roll shell which is greater than its thickness extending radially outward from the roll shell, wherein the first width is greater than the first diameter of the first holes, the first flat lead extending over the outer surface of the roll shell such that at least one of the plurality of first holes extends through the first flat lead;

a second flat lead having a second width extending along the outer surface of the roll shell which is greater than its thickness extending radially outward from the roll shell, wherein the second width is greater than the first diameter of the first holes, the second flat lead alongside and spaced from the first flat lead and extending over the outer surface of the roll shell such that at least one of the plurality of first holes extends through the second flat lead; and one or more sensors which are connected to the roll shell and connected between the first flat lead and the second flat lead.

14. The perforated roll of claim 13 further comprising:

a pre-coating layer arranged on the outer surface of the roll shell, wherein the first flat lead, the second flat lead, and the sensor are fastened to the pre-coating layer;

an insulation element disposed on the pre-coating layer and extending radially outwardly through a second hole in the first lead which communicates with one of the first holes; and an outer coating layer which overlies the pre-coating layer, the first flat lead, the second flat lead, the insulation element, and the one or more sensors.

15. The perforated roll of claim 13 wherein the one or more sensors is selected from the group consisting of an EMFi electric sensor, a PVDF electric sensor, a piezoelectric sensor, a capacitive sensor, a resistive sensor, an inductive sensor, and an eddy current sensor.

* * * * *